US006887114B2

(12) United States Patent
Liao

(10) Patent No.: US 6,887,114 B2
(45) Date of Patent: May 3, 2005

(54) ELECTRICAL CONNECTOR WITH HIGH PERFORMANCE CONTACTS

(75) Inventor: Fang-Jwu Liao, Tu-chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/896,121

(22) Filed: Jul. 20, 2004

(65) Prior Publication Data

US 2005/0042940 A1 Feb. 24, 2005

(30) Foreign Application Priority Data

Aug. 22, 2003 (TW) ..... 92215272 U

(51) Int. Cl.[7] ..... H01R 4/48
(52) U.S. Cl. ..... 439/862; 439/66; 439/81
(58) Field of Search ..... 439/66, 81, 862

(56) References Cited

U.S. PATENT DOCUMENTS 5,338,231 A * 8/1994 Wilhite ..... 439/660
5,551,883 A * 9/1996 Davis ..... 439/65
5,711,690 A * 1/1998 Thrush et al. ..... 439/862
6,203,331 B1 * 3/2001 McHugh et al. ..... 436/71
6,296,495 B1 * 10/2001 Wang et al. ..... 439/71
6,561,817 B1 * 5/2003 Ma ..... 439/66
6,585,527 B2 * 7/2003 Koopman et al. ..... 439/71
6,652,329 B1 * 11/2003 Howell et al. ..... 439/862
6,688,893 B1 * 2/2004 Huang et al. ..... 439/66
6,695,624 B1 * 2/2004 Szu ..... 439/66

* cited by examiner

*Primary Examiner*—Tho D. Ta
*Assistant Examiner*—Larisa Tsukerman
(74) *Attorney, Agent, or Firm*—Wei Te Chung

(57) ABSTRACT

An electrical connector (10) includes an insulative housing (12) and a plurality of contacts (14) accommodating in the housing. Each contact comprises a spring arm (143) defining a lower portion (144), a medial portion (145) and an upper portion (146). The upper portion includes an extending beam (147) connecting with the medial portion, a contacting portion (149) for connecting with a mating component (30), and a connecting beam (148) connecting the extending beam and the contacting portion. The extending beam has a first axis A, about which the extending beam is symmetrical, and the contacting portion has a second axis B, about which the contacting portion is symmetrical. The second axis is deflective from the first axis and an angle C is formed therebetween accordingly. Thus, the superposed area between the contacting portion and the mating component is increased, which enables more reliable electrical connection therebetween.

20 Claims, 8 Drawing Sheets

ELECTRICAL CONNECTOR WITH HIGH PERFORMANCE CONTACTS

BACKGROUND OF THE INVENTION

1. Field of the Invention

The present invention relates to an electrical connector used for electrically connecting a land grid array (LGA) electrical component to a printed circuit board (PCB).

2. Description of Related Art

An electrical connector used for electrically connecting an LGA electrical component to a PCB is widely applied in the field of electronics, and a correlative article is found in *Nonlinear Analysis Helps Design LGA Connectors* (Connector Specifier, February 2001). An electrical mating component connecting to such an electrical connector defines a plurality of conductive pads thereon. During the course of connecting the component to the electrical connector, the component is actuated to press on the electrical connector and the conductive pads connect with contacts of the electrical connector. However, the size of the contact, especially the size of the contacting portion is so small that it is important to ensure the precision of the interconnection between the conductive pad and the contacting portion of the contact. When the conventional connector is used to connect the mating component to the PCB, the contacts cannot osculate with the conductive pads completely, or, the conductive pads cannot osculate with the contacts completely. In fact, the contacts and the conductive pads conventionally partially connect with each other, which induces unstable electrical connection and weakens the transmission performance of the electrical connector.

FIGS. 6–9 disclose a conventional contact 60 used in a conventional connector 70 which is essentially shown in U.S. Pat. No. 6,652,329 having the same assignee with the instant application. The connector 70 is used to electrically connect a mating component 80 to a printed circuit board (PCB) 90. The conventional connector 70 comprises an insulative housing 72. Each contact 60 comprises a base portion 61 fastening in the housing 72, a solder portion 65 extending from the base portion 61, and a spring arm 62 extending from a lateral side of the base portion 61. The spring arm 62 further defines a connecting portion 63 extending from the spring arm 62 and a contacting portion 64 extending from a distal end of the connecting portion 63. After the contact 60 is positioned in the housing 72, the contacting portion 64 is beyond the insulative housing 72 for electrically connecting to conductive pads 800 of the mating component 70 and the solder portion 65 is attached with a solder ball 91 for connecting to the PCB 90. FIG. 8 is a top view of the contact 60 and illustrates that the connecting portion 63 and the contacting portion 64 are both symmetrical about an axis XX. Because of the size and structure limitation of the connector, the contacting portion 64 cannot osculate with the conductive pads 800 of the component 80 completely. The superposed hatched area is small, which increases the conductivity resistance and induces unstable electrical connection and weakens the transmission performance of the electrical connector.

Such connectors are served for electrical components, which makes it difficult to improve the structure of the component. The only way to solve the above-mentioned problems is to improve the connector, especially the contacts, which is just the point of this invention.

Hence, a new electrical connector having high performance contacts that overcomes the above-mentioned problems is desired.

SUMMARY OF THE INVENTION

An primary object of the present invention is to provide an electrical connector that enables reliable electrical connection between the electrical component and the PCB.

Another object of the present invention is to provide an electrical contact which can increase superposed area between a contacting portion thereof and conductive pads of a mating component.

To achieve the above-mentioned object, an electrical connector in accordance with a preferred embodiment of the present invention is used to connect a mating component to a printed circuit board, and includes an insulative housing and a plurality of contacts accommodating in the housing. Each contact comprises a spring arm defining a lower portion, a medial portion and an upper portion. The upper portion further includes an extending beam connecting with the medial portion, a contacting portion for connecting with a mating component, and a connecting beam linking the extending beam and the contacting portion. The extending beam has a first axis, about which the extending beam is symmetrical, and the contacting portion has a second axis, about which the contacting portion is symmetrical. The second axis is deflective from the first axis on a plane parallel to the mating component, and an angle is formed therebetween accordingly. Thus, the superposed area between the contacting portion and the mating component is increased, which enables more reliable electrical connection therebetween.

Other objects, advantages and novel features of the present invention will become more apparent from the following detailed description when taken in conjunction with the accompanying drawings, in which:

DESCRIPTION OF THE PREFERRED EMBODIMENT

Reference will now be made to the drawings to describe the present invention in detail.

Figure 1:
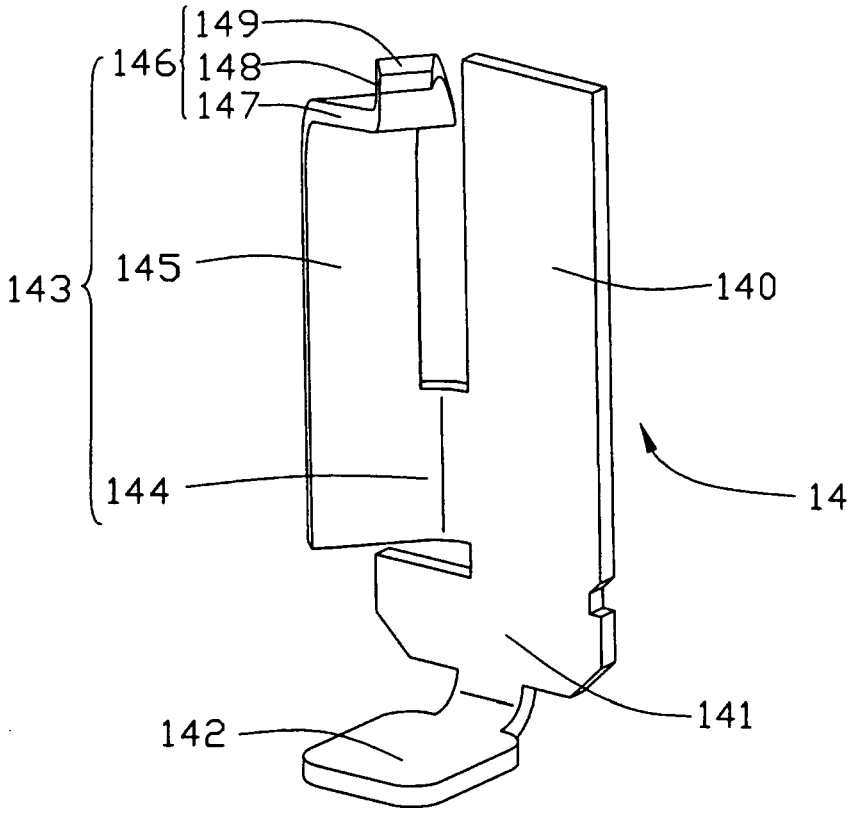
FIG. 1 is an isometric view of an electrical contact used in an electrical connector in accordance with the preferred embodiment of the present invention.
Figure 2:
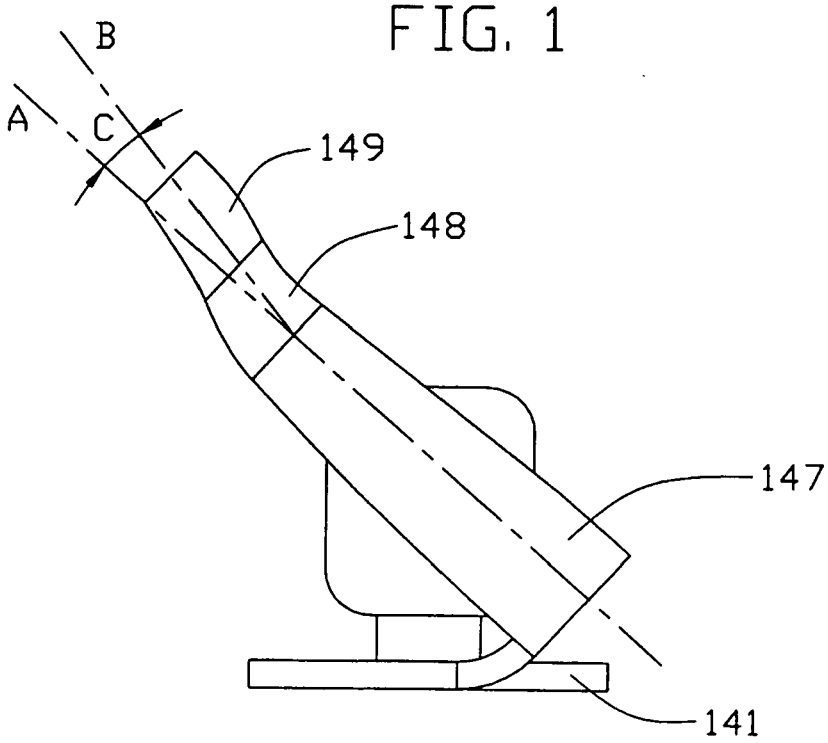
FIG. 2 is a top view of the contact of FIG. 1.
Figure 3:
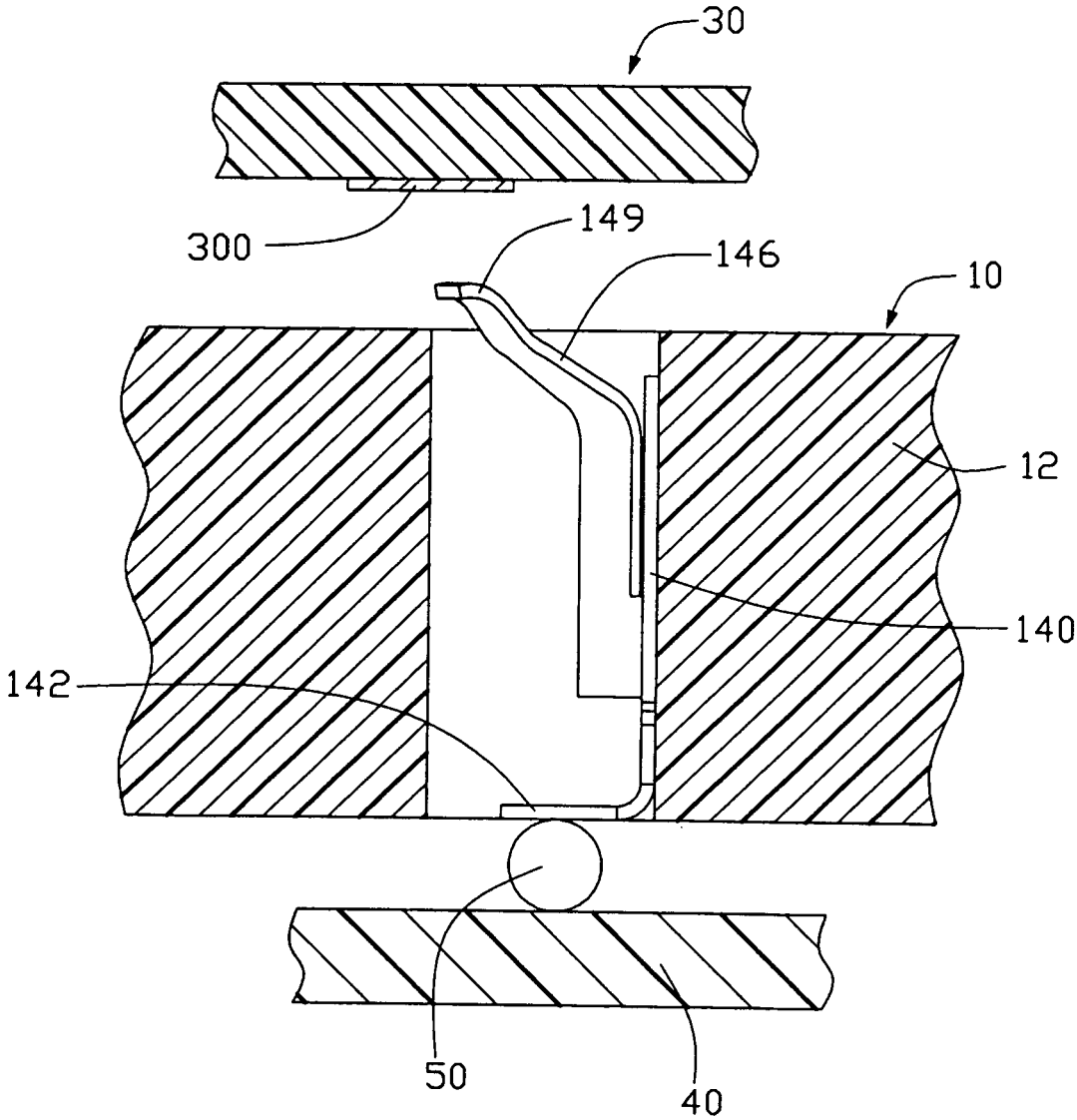
FIG. 3 is a simplified view showing the contact received in an insulative housing and connected to a printed circuit board via a solder ball, for being ready to connect with a mating component.
Figure 4:
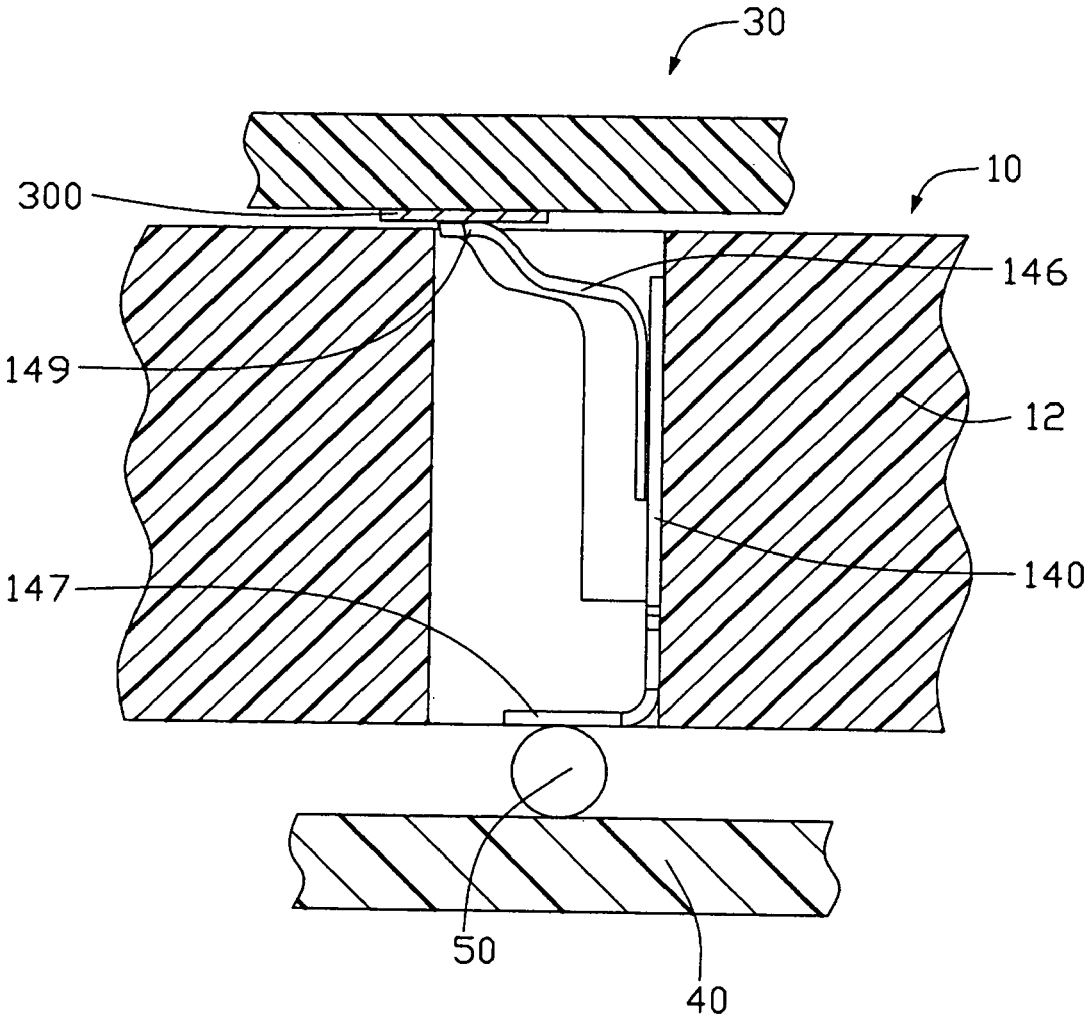
FIG. 4 is similar to FIG. 3, but showing the contact connected with the mating component.
Figure 5:
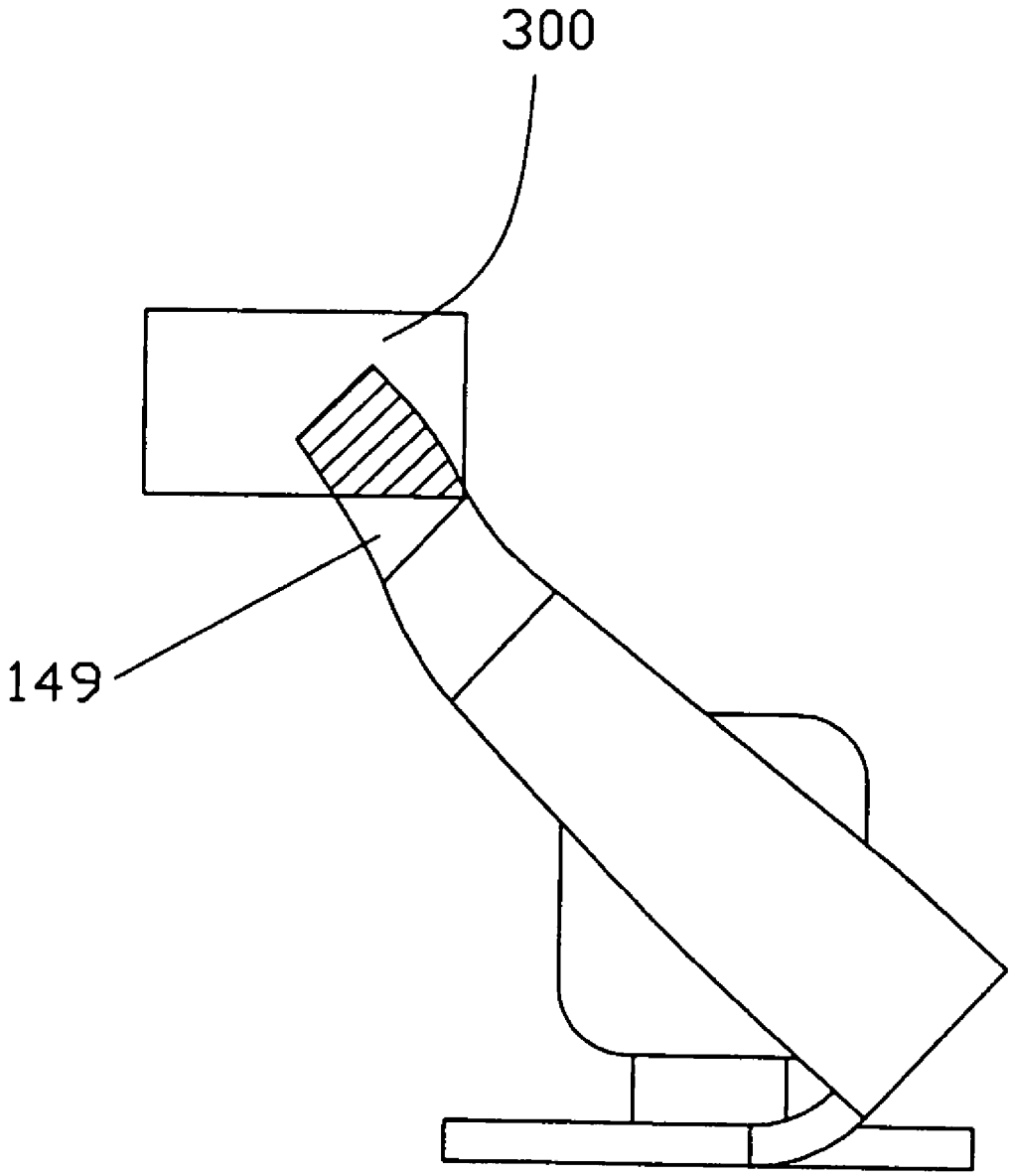
FIG. 5 is similar to FIG. 2, but showing a conductive pad of the mating component contacting therewith.
Figure 6:
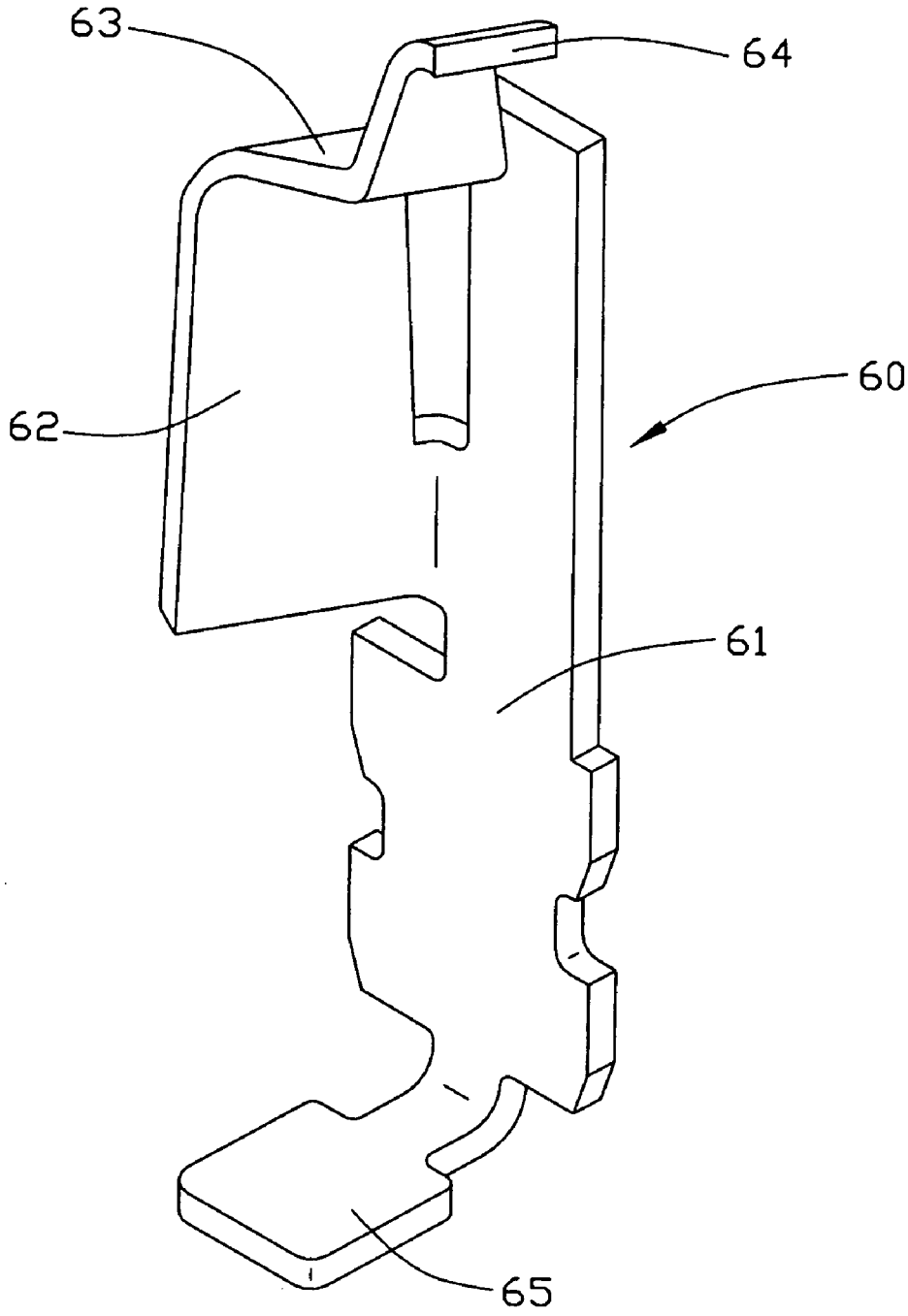
FIG. 6 (PRIOR ART)
FIG. 6 is an isometric view of an electrical contact used in a conventional connector.
Figure 7:
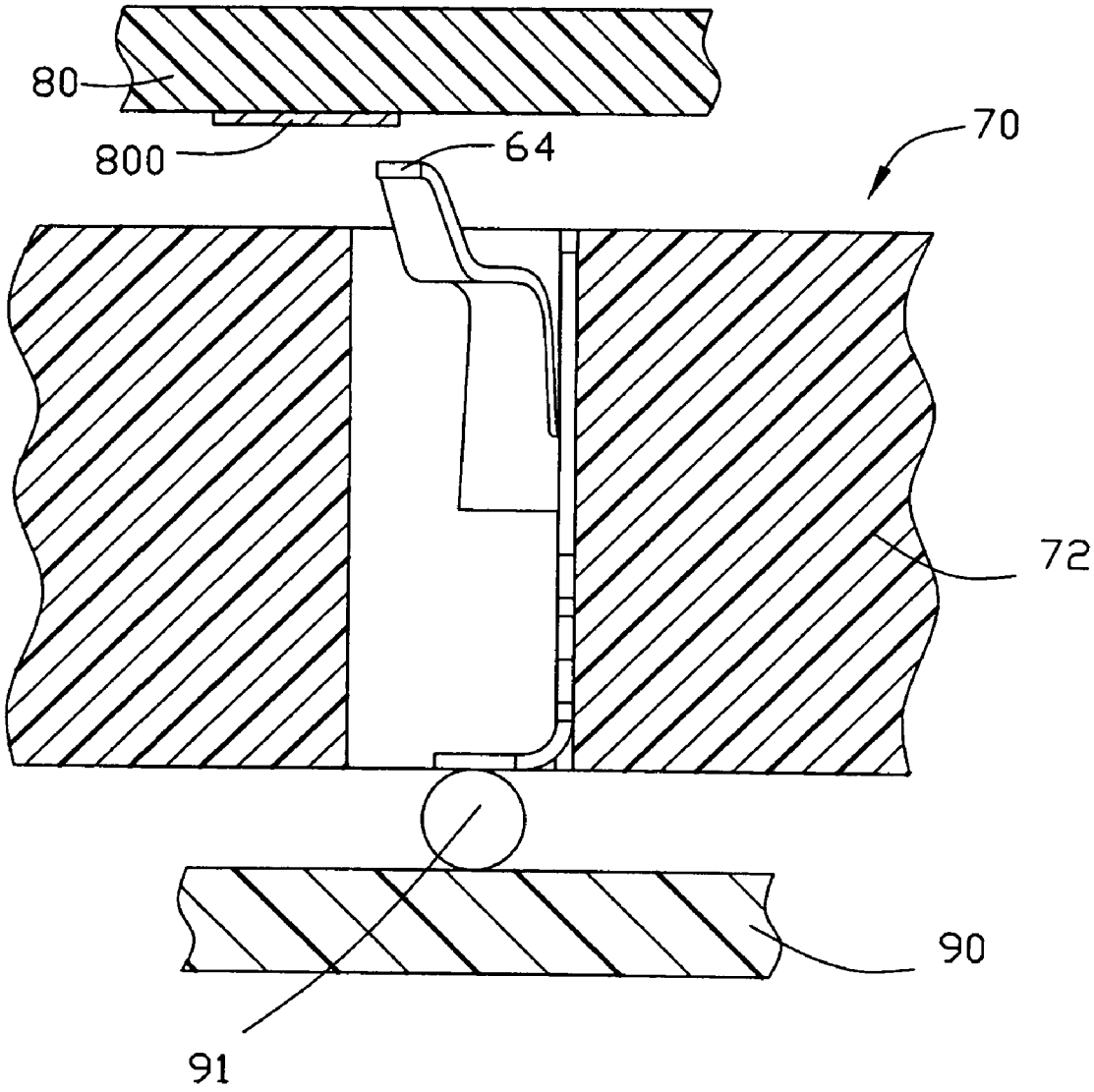
FIG. 7 (PRIOR ART)
FIG. 7 is a simplified view showing the contact of FIG. 5, received in an insulative housing and connected to a printed circuit board via a solder ball, for being ready to connect with a mating component.
Figure 8:
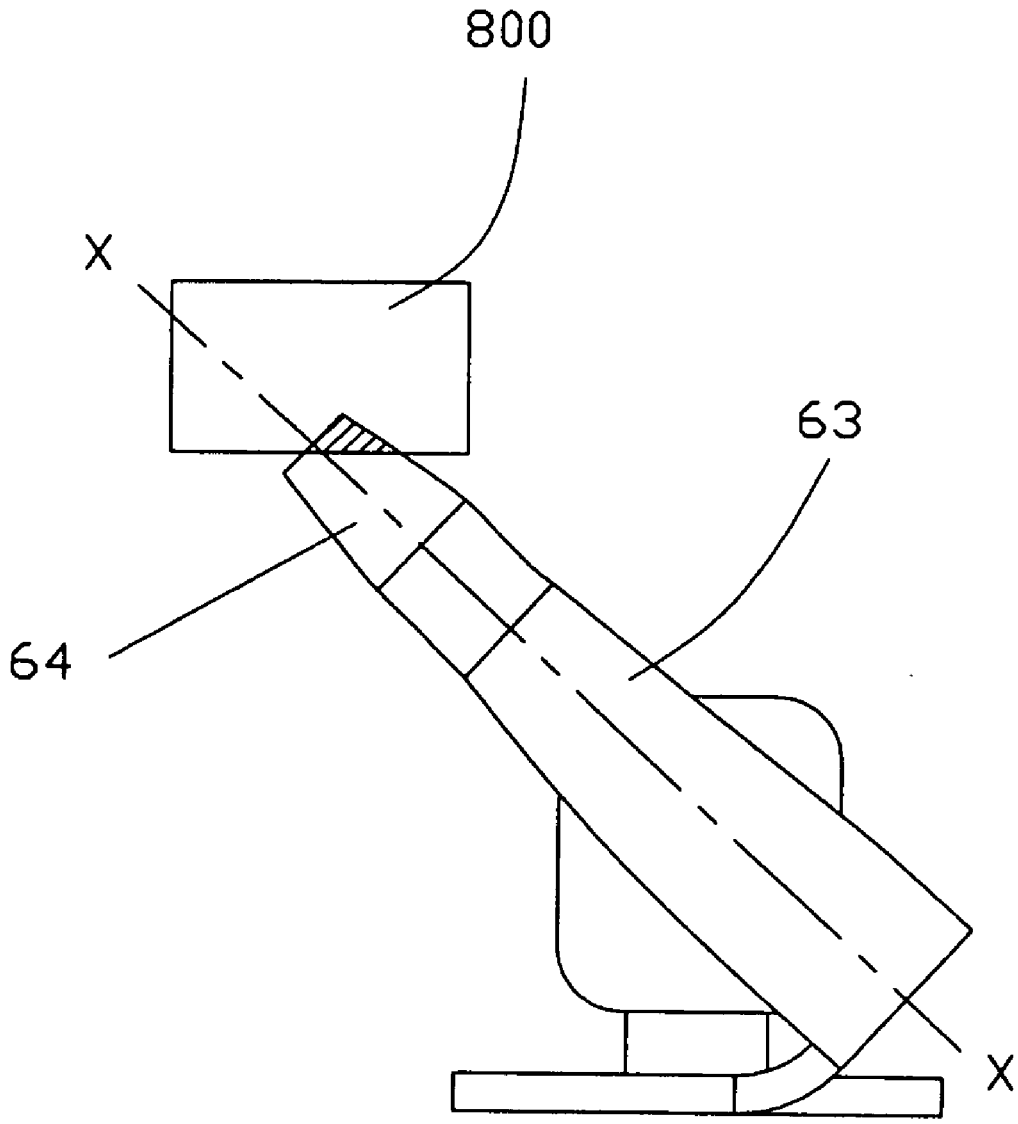
FIG. 8 (PRIOR ART)
FIG. 8 is a top view of the conventional contact, showing a conductive pad of a mating component connecting therewith.
Figure 9:
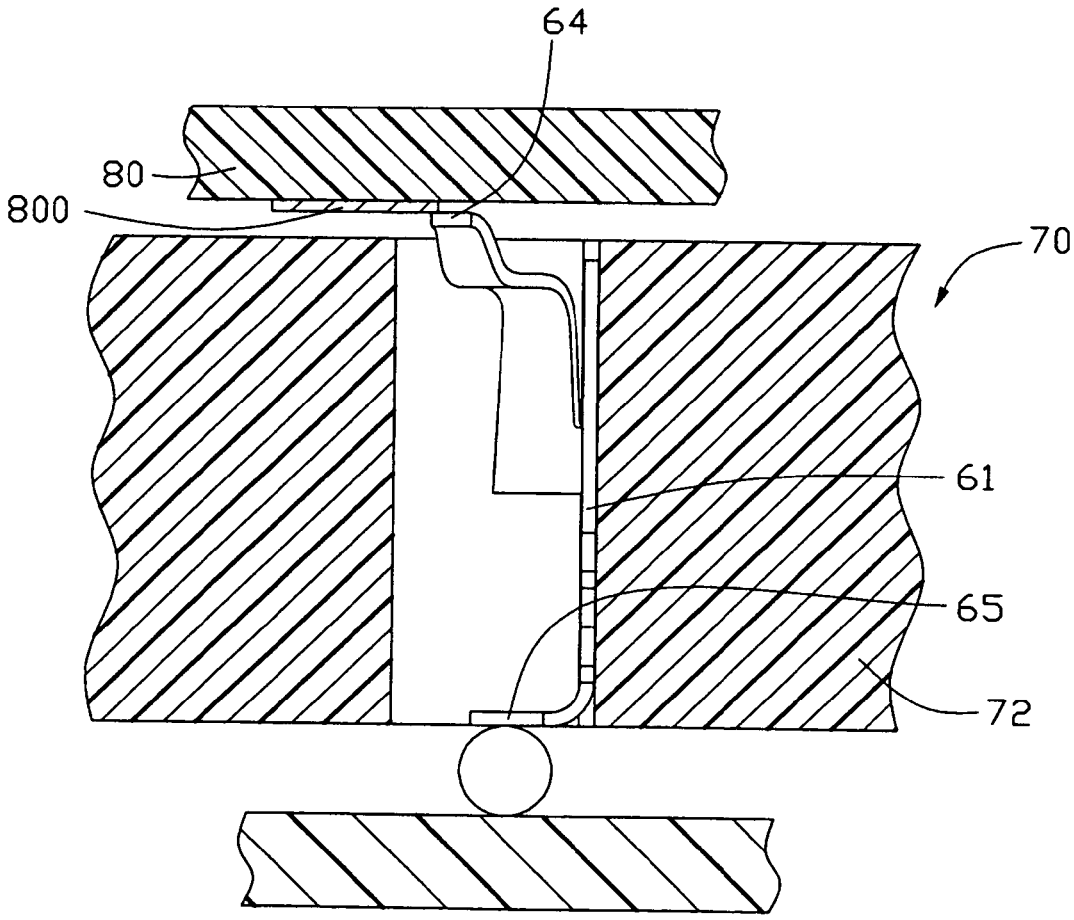
FIG. 9 (PRIOR ART)
FIG. 9 is similar to FIG. 6, but showing the contact connected with the mating component.

Referring to FIGS. 1~3, especially to FIG. 3, an electrical connector 10 of the present invention in accordance with a preferred embodiment is used for connecting a mating component 30 to a printed circuit board (PCB) 40 via a solder ball 50. The electrical connector 10 comprises an insulative housing 12 and a plurality of electrical contacts 14 received in the housing 12. The mating component defines a plurality of conductive pads 300 corresponding to the electrical contacts 14 of the connector 10.

Referring to FIG. 1, each contact 14 comprises a plate-like base portion 140, a fastening portion 141 extending form the base portion 140 for accommodating the contact 14 in the housing 12 interferentially, a soldering portion 142 extending vertically form the fastening portion 141, and a spring arm 143 obliquely extending from a lateral side of the base portion 140. The spring arm 143 includes a lower portion 144 connecting with the base portion 140, an upper portion 146 for flexibly connecting with the conductive pad 300 of the mating component 30, and a medial portion 145 connecting the lower and upper portions. The upper portion 146 defines an extending beam 147 extending from the medial portion 145, a connecting beam 148 rising from the extending beam 147, and a contacting portion 149 formed at a distal end of the connecting beam 148. When the contact 14 is installed in the housing 12, the contacting portion 149 extends out of the housing 14 and the soldering portion 142 is attached with a solder ball 50 for being surface mounted on the PCB 40.

Referring to FIGS. 2–5, the extending beam 147 has a first axis A, about which the extending beam 147 is symmetrical, and the contacting portion 149 has a second axis B, about which the contacting portion is symmetrical. The second axis B is deflective from the first axis A and an angle is formed therebetween on a plane parallel to the mating component 30. As a result, referring to FIG. 5, the superposed hatched area between the contacting portion 149 and the conductive pad 300 of the mating component 30 is increased, which provides more reliable electrical connection therebetween. In this preferred embodiment, the first axis A simultaneity forms another angle relative to the second axis B on a plane perpendicular to the circuit board.

The present invention is to resolve the non-alignment problem between the contacting portion and the conductive pad of the mating component, and the pivotal feature of this invention is to deflect the contacting portion to increase the superposed area between the contacting portion and the conductive pad of the mating component. The deflecting direction of the contacting portion lies on the material and actual figuration of the component. From one viewpoint, the extending beam 147 extends along somewhat a diagonal direction for obtaining the maximum bending arm to increase the resiliency thereof, and the connecting beam 148 and the contact portion 149 both located above the extending beam 147 extend in another direction oblique to the diagonal direction for directing/tilting to the corresponding conductive pad and superposing the corresponding conductive pad as much as possible. It is noted that in the embodiment because the joining lines (not labeled) between the connecting beam 148 and the contact portion 149, between the connecting beam 148 and the extending beam 147, and between the extending beam 147 and the medial portion 145, are all parallel to one another, it is understood that the connecting beam 148 and the contact portion 149 essentially already extend oblique to the extending beam 147 when the whole contact 14 is just stamped from sheet metal in an expanded manner and before formed to its final shape.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

What is claimed is:

1. An electrical connector used for electrically connecting a mating electrical component having conductive pads to a printed circuit board comprising:

an insulative housing;

a plurality of electrical contacts held in the housing interferentially;

each contact comprising a plate-like base portion, a fastening portion accommodated in the housing, a spring arm extending from the base portion, and a soldering portion for connecting to the printed circuit board;

the spring arm comprising a lower portion connecting to the base portion, a medial portion extending from the lower portion, an upper portion formed at a distal end of the medial portion for connecting to the electrical component;

the upper portion defining an extending beam having a first axis about which the extending beam is symmetrical, and a contacting portion having a second axis about which the contacting portion is symmetrical; wherein the first axis is deflected from the second axis and accordingly an angle is formed therebetween on a plane parallel to the mating electrical component;

wherein the upper portion of the spring arm further defines a connecting beam for raising the contacting portion to a position higher than an upper surface of the housing; and the wherein spring arm obliquely extends from a lateral side of the base portion.

2. An electrical connector for electrically connecting a mating component to a printed circuit board comprising:

an insulative hosing;

a plurality of electrical contacts accommodated in the housing;

each contact defining a base portion, a fastening portion accommodated in the housing, a spring arm extending from the base portion, and a soldering portion connecting to the printed circuit board, and the spring arm further defining an extending beam and a contacting portion; wherein an extending direction of the extending beam is deflective from an extending direction of the contacting portion on a plane parallel to the mating component, wherein the extending beam defines a first axis and the contacting portion defines a second axis, and the first axis is deflective from the second axis on planes parallel and perpendicular to the printed circuit board.

3. The electrical connector as described in claim 2, wherein the upper portion of the spring arm further defines a connecting beam for raising the contacting portion to a position higher than an upper surface of the housing.

4. The electrical connector as described in claim 2, wherein the spring arm obliquely extends from a lateral side of the base portion.

5. An electrical connector assembly comprising:

an electronic package with a plurality of conductive pads on an underside thereof;

an insulative housing defining a plurality of passageways therein;

a plurality of contacts disposed in the corresponding passageways, respectively, each of said contacts including:

an extending beam extending upwardly and in a direction from a top view; and a contact region located above an upper portion of the extending beam, and including thereof at least one portion extending upwardly and in another direction oblique to said direction from the top view, said contact region extending above a top face of the housing and engaging the corresponding conductive pad; wherein the extending beam provides most of resiliency of the contact when the contact abuts against the corresponding downwardly pressing conductive pad, and the at least on portion of the contact region is intentionally oblique to the extending beam, from the top view, to direct to the corresponding conductive pad for maximizing the superposing areas therebetween.

6. The assembly as described in claim 5, wherein an oblique relation between the extending beam and the at least one portion of the contact region exists when the contact is in an expanded manner on sheet metal.

7. The assembly as described in claim 5, wherein said contact further includes a base portion with a coplanar retention section thereabouts, and said base portion essentially abuts against one circumferential wall in the corresponding passageway.

8. The assembly as described in claim 7 wherein said contact further includes a medial portion connected between the base portion and the extending beam.

9. The assembly as described in claim 8, wherein said medial portion defines a plane which is essentially perpendicular to said diagonal direction.

10. The assembly as described in claim 5, wherein said direction is essentially diagonal relative to the housing.

11. An electrical connector assembly comprising:

an electronic package with a plurality of conductive pads on an underside thereof;

an insulative housing defining a plurality of passageways therein;

a plurality of contacts disposed in the corresponding passageways, respectively, each of said contacts including:

a base portion;

a soldering portion located below the base portion for mounting to a printed circuit board;

an arm defining thereof a lower portion integrally extending from the base portion, and an upper portion opposite to said lower portion, said upper portion essentially extending in an upward oblique direction from a side view, said upper portion including:

an extending beam defining a first axis along a first lengthwise direction thereof from a top view;

a connecting beam extending from an upper end of the extending beam and defining a second axis along a second lengthwise direction thereof from the top view, said first direction and said second direction defining an acute angle therebetween;

a contacting portion extending from an upper end of the connecting beam for engagement with the corresponding pad; wherein the contacting portion is essentially laterally offset from a centerline of the extending beam from the top view.

12. The electrical connector assembly as claimed in claim 11, wherein said base portion defines a plane.

13. The electrical connector assembly as claimed in claim 12, wherein a medial portion is connected between the upper portion and the lower portion.

14. The electrical connector assembly as claimed in claim 13, wherein both said medial portion and said lower portion commonly lie in another plane.

15. The electrical connector assembly as claimed in claim 14, wherein both said plane and said another plane are vertical planes relative to the housing.

16. The electrical connector assembly as claimed in claim 15, wherein said another plane is oblique to said plane.

17. The electrical connector assembly as claimed in claim 12, wherein said plane is parallel to an internal side wall of the housing beside the corresponding passageway.

18. The electrical connector assembly as claimed in claim 12, wherein each of said contacts further includes a fastening portion located between the base portion and the soldering portion for retaining the contact in the corresponding passageway.

19. The electrical connector assembly as claimed in claim 18, wherein said fastening portion is coplanar with said base portion in said plane.

20. The electrical connector assembly as claimed in claim 11, wherein said lower portion extends from a lateral edge of said base portion.

* * * * *

US006887114C1

(12) EX PARTE REEXAMINATION CERTIFICATE (10736th)

United States Patent
Liao

(10) Number: US 6,887,114 C1
(45) Certificate Issued: Oct. 13, 2015

(54) ELECTRICAL CONNECTOR WITH HIGH PERFORMANCE CONTACTS

(75) Inventor: Fang-Jwu Liao, Tu-chen (TW)

(73) Assignee: HON HAI PRECISION IND. CO., LTD., Tu-Chen, Taipei Hsien (TW)

Reexamination Request:
No. 90/012,447, Aug. 22, 2012

Reexamination Certificate for:

| | |
|---|---|
| Patent No.: | **6,887,114** |
| Issued: | **May 3, 2005** |
| Appl. No.: | **10/896,121** |
| Filed: | **Jul. 20, 2004** |

(30) Foreign Application Priority Data

Aug. 22, 2003 (TW) ..... 92215272 U

(51) Int. Cl.

| | |
|---|---|
| ***H01R 13/24*** | (2006.01) |
| ***H01R 13/22*** | (2006.01) |
| ***H01R 4/02*** | (2006.01) |

(52) U.S. Cl.
CPC ..... *H01R 13/2442* (2013.01); *H01R 4/024* (2013.01)

(58) Field of Classification Search
None
See application file for complete search history.

(56) References Cited

To view the complete listing of prior art documents cited during the proceeding for Reexamination Control Number 90/012,447, please refer to the USPTO's public Patent Application Information Retrieval (PAIR) system under the Display References tab.

*Primary Examiner* — Hetul Patel

(57) ABSTRACT

An electrical connector (10) includes an insulative housing (12) and a plurality of contacts (14) accommodating in the housing. Each contact comprises a spring arm (143) defining a lower portion (144), a medial portion (145) and an upper portion (146). The upper portion includes an extending beam (147) connecting with the medial portion, a contacting portion (149) for connecting with a mating component (30), and a connecting beam (148) connecting the extending beam and the contacting portion. The extending beam has a first axis A, about which the extending beam is symmetrical, and the contacting portion has a second axis B, about which the contacting portion is symmetrical. The second axis is deflective from the first axis and an angle C is formed therebetween accordingly. Thus, the superposed area between the contacting portion and the mating component is increased, which enables more reliable electrical connection therebetween.

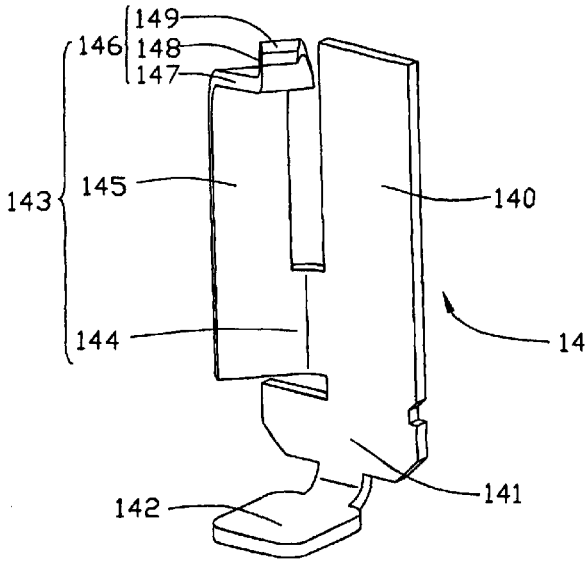

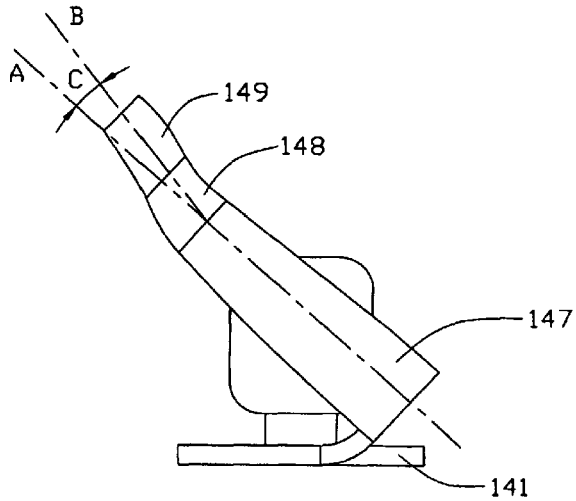

EX PARTE REEXAMINATION CERTIFICATE

THE PATENT IS HEREBY AMENDED AS INDICATED BELOW.

AS A RESULT OF REEXAMINATION, IT HAS BEEN DETERMINED THAT:

Claims 1-20 are cancelled.

* * * * *